US005872324A

United States Patent [19]

Watson, Jr et al.

[11] Patent Number: 5,872,324

[45] Date of Patent: Feb. 16, 1999

[54] TRIMODE FUZE

[75] Inventors: Fred W. Watson, Jr, Montross, Va.; Steve N. Chan, Silver Springs, Md.

[73] Assignee: The United States of America as represented by the Secretary of the Navy, Washington, D.C.

[21] Appl. No.: 888,382

[22] Filed: Jul. 7, 1997

[51] Int. Cl.[6] ..... F42C 9/14

[52] U.S. Cl. ..... 102/265; 102/247; 102/499

[58] Field of Search ..... 102/246, 247, 102/248, 265–269, 499, 500

[56] References Cited

U.S. PATENT DOCUMENTS

| | | | |
|---|---|---|---|
| 1,531,717 | 3/1925 | Remondy | 102/265 |
| 1,585,686 | 5/1926 | Pantoflicek | 102/265 |
| 2,465,395 | 3/1949 | O'Rear | 102/265 |
| 4,693,180 | 9/1987 | Weber et al. | 102/265 |
| 5,591,935 | 1/1997 | Shamblen et al. | 102/269 |

FOREIGN PATENT DOCUMENTS

| | | | |
|---|---|---|---|
| 548039 | 9/1942 | United Kingdom | 102/265 |

*Primary Examiner*—Harold J. Tudor
*Attorney, Agent, or Firm*—James B. Bechtel, Esq.

[57] ABSTRACT

A trimode fuze is provided which comprises a combination of a standard dual mode fuze with the addition of a void sensing mechanism. The modified fuze provides detonation of a warhead under three distinct scenarios: impact upon a hard target with detonation caused by the deformation of the warhead, displacing the hard target firing pin, penetration and continuous deceleration within a solid target with detonation caused by the expiration of a penetration delay timer, and penetration of a soft target with detonation caused by the transition from a target impact deceleration to the lower preset deceleration threshold.

The first two modes of detonation are similar to those found in prior art dual mode fuzes. The third mode is brought about when target impact deceleration causes compression of a spring. As the spring compresses, steel balls slide out of a locking mechanism. Once said deceleration reduces below a preset threshold, an additional set of steel balls is released, which allows the spring loaded firing pin to impact on the detonator.

8 Claims, 5 Drawing Sheets

TRIMODE FUZE

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to the ammunitions and explosives field and in particular to explosives capable of detonation based on impact conditions.

BACKGROUND OF THE INVENTION

The challenge of providing optimal explosive delivery to a multitude of different target types has long existed. Specifically, there are three main types of potential targets. The first are relatively impenetrable hardened targets such as heavily armored vehicles, brick walls and concrete reinforced bunkers and buildings. For this type of target, the penetration of the incoming warhead will generally be minimal, and the nose and fuze of the warhead will be crushed and deformed by the impact. In the event that the warhead strikes this type of hardened target, a mechanism is necessary to guarantee that the fuze activates the primary explosive despite this crushing and deformation.

The second type of target, a fortified but penetrable target, is one with a relatively dense and thick, but penetrable skin, such as sandbagged timber bunkers, earth covered structures, or light armored vehicles. With this type of target, the optimal explosion allows the warhead enough time after impact to generate substantial penetration before exploding.

The final type of target, a light structured soft target, is one with a relatively thin or easily penetrable skin, for instance, glass windows, thin wooden doors, or thin metal. With these targets, the optimal explosion is obtained by detonating the warhead immediately after the outer skin of the target has been breached.

Prior art efforts disclose dual mode technology. These types of fuzes deal with the first two target types. In the case of an extremely hardened target, a mechanical firing pin is driven into the detonator by the deformation of the warhead. Using this mechanism, the warhead detonates upon impact with a target sufficiently hardened that physical destruction of the warhead would occur prior to any significant penetration. In the second type of target, an inertial plunger is used to detect the sudden deceleration caused by the impact against a penetrable object. The inertial plunger senses deceleration and initiates a delay train which then detonates the weapon after a set period of time.

However, the dual mode technology has been relatively ineffective for light structure targets. In the case of these targets, the time elapsed before the explosion is sufficiently great that the warhead moves beyond the optimal explosive area before the time delay element initiates the explosive train. For instance, in the case of light structured vehicles including helicopters and airplanes, a hit by a standard dual mode fuze enabled missile typically results in the missile passing entirely through the target and exploding at a substantial distance beyond the target.

No prior art provides a weapon capable of automatically adapting to all three types of targets.

Further, any new enhancement to the prior art must also overcome the problem of detecting the penetration of an object. The inertial changes experienced by a weapon passing through a soft target are typically small and often outside the operating limits of current dual mode fuzes. As a result, a warhead may pass through a soft target without initiating the fuzing sequence at all.

SUMMARY OF THE INVENTION

Accordingly, it is an object of the invention to provide the ability for the warhead to detonate appropriately when the target is impenetrable or sufficiently hardened as to cause physical disintegration of the warhead.

It is another object of the invention to provide the ability for the warhead to detonate appropriately when the target is fortified but penetrable (i.e., does not cause physical disintegration of the warhead) by sensing the deceleration of the round.

It is yet another object of this invention to provide detonation of the warhead immediately after penetration of a light structure target with easily penetrable skin by sensing the changes in deceleration of the round. This object is a very important feature. The second mode senses deceleration to trigger the firing, but the third mode senses the changes in deceleration (void sensing) to trigger the firing.

Accordingly, the invention is a trimode fuze, for use in the warhead of a shoulder-fired rocket weapon or any similar projectile weapon, having an instantaneous mechanism, a timer mechanism, and a void-sensing mechanism, each mechanism providing detonation of the warhead independently of the others. The fuze assembly comprises a casing which serves as the structural containment for the booster pellet which, in turn, provides the initiation of the main warhead. A hard target impact detonator is located on the forward end of the fuze assembly providing a mechanical, instantaneous detonation of the warhead in the event that the target impact results in a physical crushing of the warhead. A second detonator located within the casing provides a pyrotechnic timer-operated delay for penetration of hardened targets. This timer is initiated by initial impact and continuous deceleration of the warhead when the integrity of the warhead is maintained. A third detonator provides an instantaneous, void-sensing detonation capability for the fuze. Operation of the third detonator is initiated by initial impact and the interruption of the continuous deceleration required by the delay detonator. Once target penetration begins, any variation in the rate of deceleration results in an immediate initiation of the main warhead by the void sensor.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
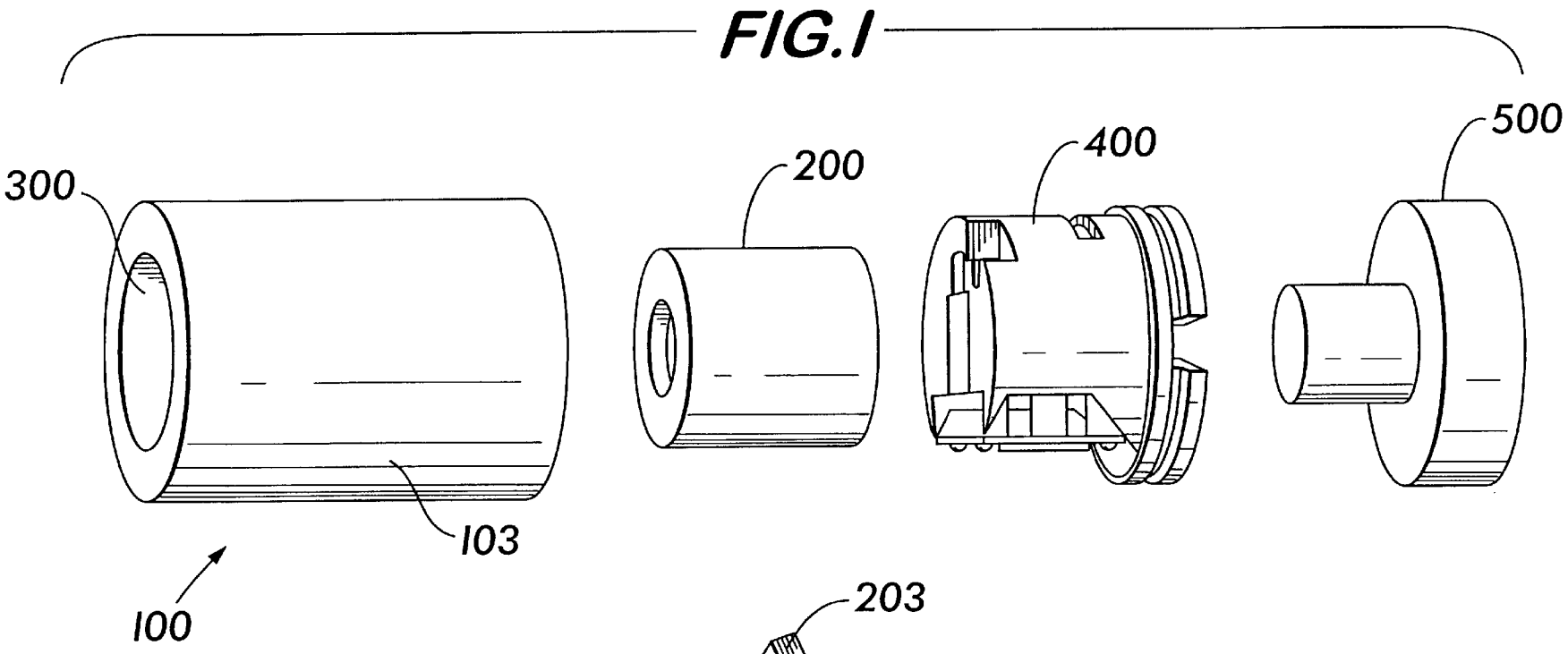
FIG. 1 is an exploded high level modular depiction of the major components of the trimode fuze.

In all figures, the orientation of the drawing is forward to the left (the warhead end to the left).

Referring now to FIG. 1, the trimode fuze, designated generally by the reference number 100, is shown with its major components. Trimode fuze 100 is composed of three main detonation modules within fuze casing 103. Fuze casing 103 provides structural support for all fuze components and must be made of a material which is strong enough to maintain alignment and integrity of the fuze under impact conditions.

The first module, the hard target impact detonator 300, is located at the forward most end of fuze casing 103. Hard target impact detonator 300 provides initiation of the warhead if the weapon impacts with an impenetrable target.

The second module, void fuze 200, is located within the hollow interior of fuze casing 103 directly behind hard target detonator 300 in the center section of the casing. Void fuze 200 provides initiation of the warhead if the weapon experiences a penetration deceleration followed by a change in the deceleration rate (e.g., the weapon enters the target interior or void). This void fuzing mode allows destruction of soft targets which have previously been relatively undamaged by dual mode fused weapons.

The third module, delay detonator 400 slides into the hollow interior of fuze casing 103 directly behind void fuze 200 in the aft end of the casing. Delay detonator 400 provides a deceleration activated, timer based initiation mode of the warhead. This mode allows the weapon to be effectively used against semi-penetrable or thick skinned targets where some degree of penetration is desired before weapon detonation.

In addition to the three detonation modules, trimode fuze 100 also contains booster module 500. Booster module 500 caps the rear of fuze casing 103 and is in contact with delay detonator 400. Booster module 500 contains the necessary components to trigger the explosion of the warhead payload upon initiation by any of the three modules.

Figure 2:
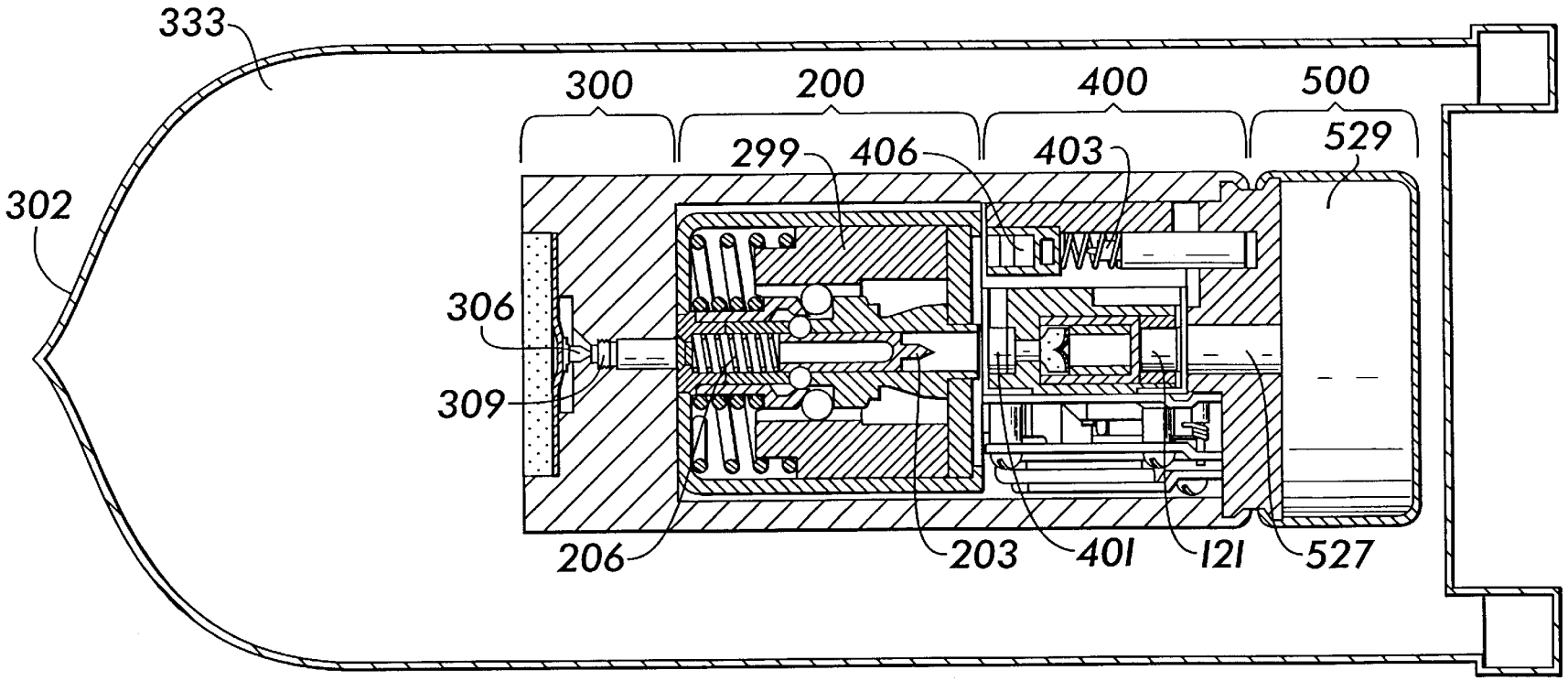
FIG. 2 is a cross-sectional depiction of the trimode fuze as loaded within a warhead.

Referring now to FIG. 2, trimode fuze 100 is shown as installed in the nosecone of a standard missile or other similar projectile weapon. The main body of trimode fuze 100 is located directly behind warhead 302 such that hard target impact detonator 300 is directly in contact with warhead 302. If the missile impacts a hardened target (i.e. impenetrable target), warhead 302 collapses and is pushed backwards driving impact firing pin 306 into impact stab detonator 309. The pyrotechnic output from the detonation of impact stab detonator 309 channels down through the hollowed void firing pin 203 to initiate pyrotechnic relay 401.

If the missile impacts a soft target, that is, a target having an outer skin and a void interior, void firing pin 203 is activated by the release of void mechanisms 299. When void mechanisms 299 release, void firing spring 206 is able to push void firing pin 203 backward into pyrotechnic relay 401. Alternately, if neither warhead crushing nor void sensing occurs, the delay detonator 400 begins a timer-initiated sequence through the pyrotechnic delay assemblies 406.

Once pyrotechnic relay 401 is activated, either by the impact of void firing pin 203 or through the activation of pyrotechnic delay assemblies 406 by inertia firing pin 403, fuze detonator 121 is ignited. Fuze detonator 121 ignites booster lead 527 which, in turn, ignites booster pellet 529. The detonation of booster pellet 529 is sufficient to detonate the weapon warhead.

The order of the modules, with hard target impact detonator 300 located behind warhead 302, void fuze 200 located behind hard target impact detonator 300, delay detonator 400 located behind void fuze 200, and booster module 500 located at the rearmost end of trimode fuze 100 is important. It is also important that the firing channel of each module of trimode fuze 100 be aligned so that firing sequences can be transferred between modules to booster module 500. Fuze casing 103 is not depicted in this figure, equivalent structural integrity is provided by missile warhead material 333.

Figure 3:
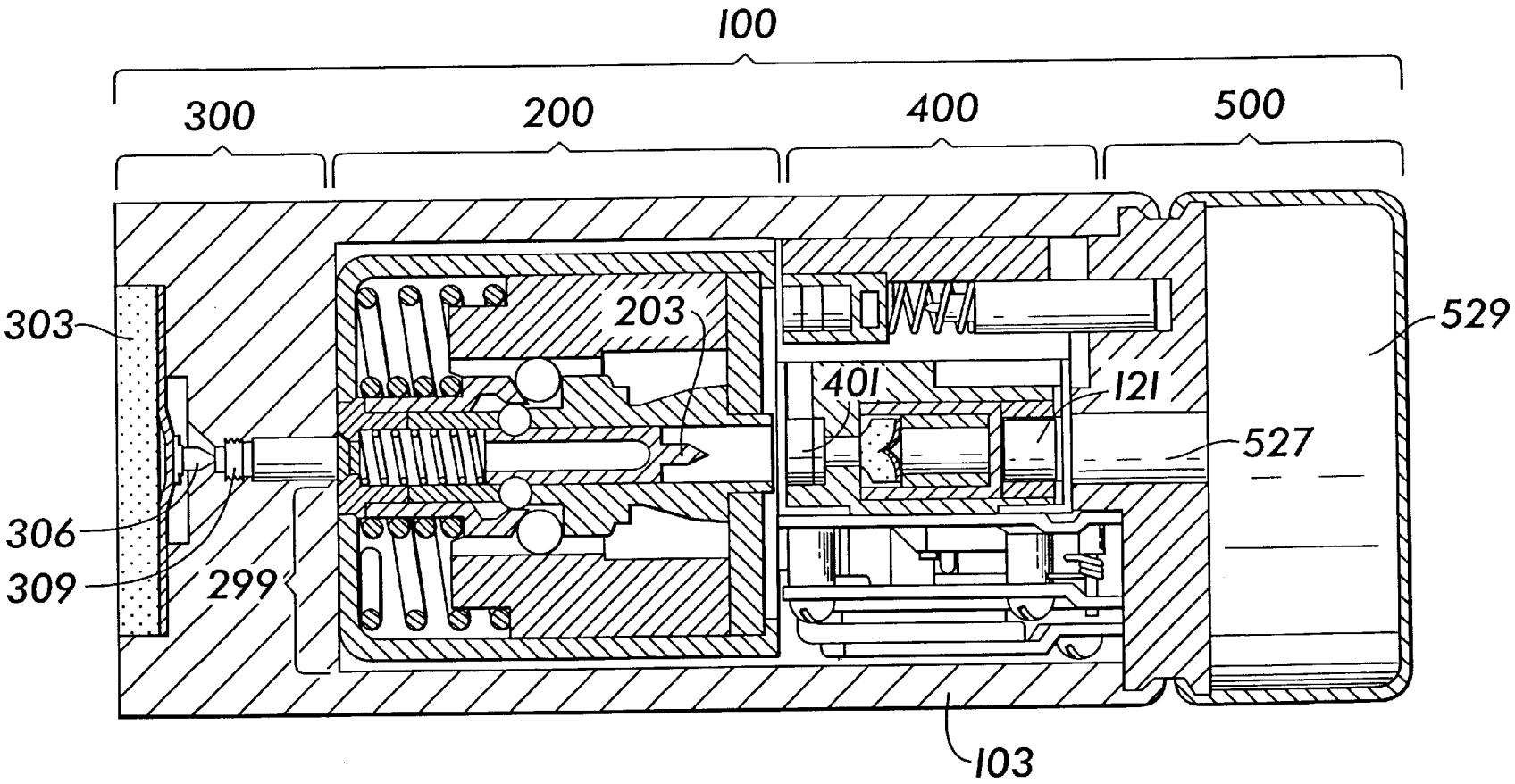
FIG. 3 is a cross-sectional side view of the trimode fuze showing the interconnections between each of the fuze modules.

Referring now to FIG. 3, additional detail of trimode fuze 100 and the fuze components is presented. Each of the three fuze modules, hard target impact detonator 300, void fuze 200, and delay detonator 400, achieve one of the three detonation modes of the present invention.

Delay detonator 400 provides the delay functionality when the weapon impacts on penetrable targets. It also provides weapon safing functionality since it is the last module before booster module 500. By sensing deceleration caused by impact with a solid but penetrable target, inertial firing pin 403 is forced into and initiates pyrotechnic delay assemblies 406. Upon the elapse of pyrotechnic delay assemblies 406, which in turn initiates pyrotechnic relay 401, fuze detonator 121 is initiated which in turn initiates booster lead 527 and booster pellet 529, thereby initiating the main warhead.

However, if the warhead subsequently exits the solid target prior to the delay time of pyrotechnic delay assemblies 406, this condition is detected by void fuze 200. Void mechanism 299 is activated by the change in deceleration and releases void firing pin 203, allowing it to drive into pyrotechnic relay 401, thus triggering the detonation.

Figure 6:
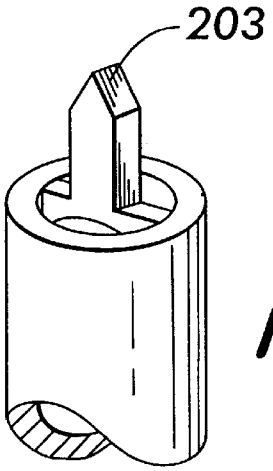
FIG. 6 is a perspective view showing the hollowed void firing pin.

Finally, if the weapon impacts a solid impenetrable target, silicone pad 303 is driven backwards by the displacement of the explosive of the deforming warhead which in turn drives impact firing pin 306 into impact stab detonator 309. The pyrotechnic output from the detonation of impact stab detonator 309 channels down through the hollowed void firing pin 203 to initiate pyrotechnic relay 401 and detonate the weapon as previously described. FIG. 6 shows a perspective view of the hollowed configuration of void firing pin 203.

All fuze components are housed within fuze casing 103. Fuze casing 103 provides structural support and exterior shaping of trimode fuze 100. Fuze casing 103 provides sufficient structural integrity to control deformation of trimode fuze 100 such that, during severe warhead deformation or crushing, or detonation by impact stab detonator 309 occurs.

Figure 4:
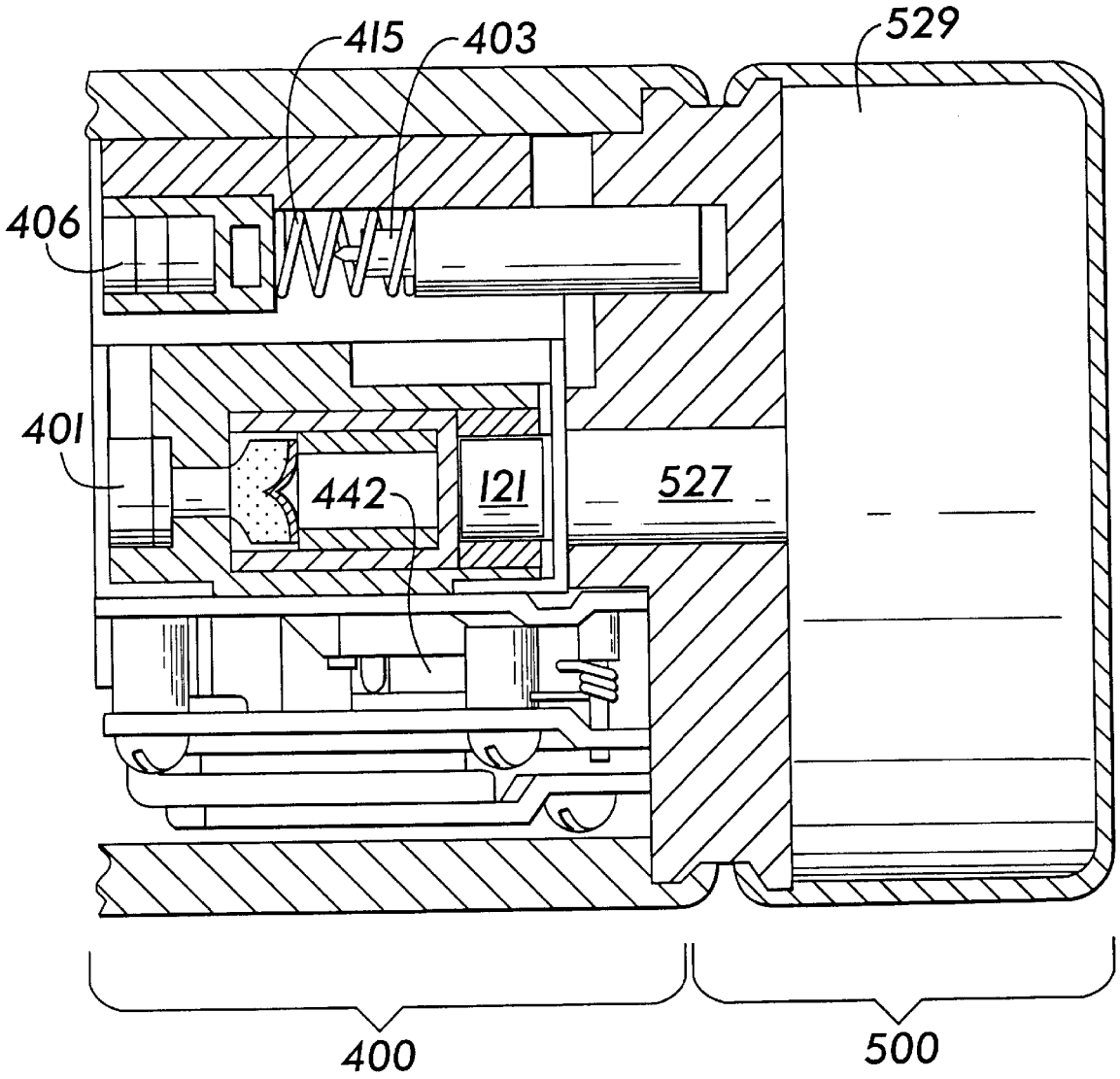
FIG. 4 is a cross-sectional side view of the delay detonator.

Referring now to FIG. 4, a detailed view of delay detonator 400 is provided. Delay detonator 400 serves two functions. First, it acts as the safety for the trimode fuze. When the weapon is unarmed (prior to firing), the firing channel occupied by pyrotechnic relay 401 and fuze detonator 121 is rotated 270 degrees out of alignment with booster lead 527 and impact firing pin 306. While the firing channel is rotated out of alignment, even if fuze detonator 121 is inadvertently activated, it is not in contact with booster lead 527 and therefore will not cause explosion of the main weapon warhead. This safety feature prevents detonation of weapons which are dropped or mishandled. Only upon firing, spring-loaded leaf safety 442 is released. The pressure of the springs in the safety rotate a rotor module through 270 degrees, bringing its firing channel into alignment. After release of spring loaded leaf safety 442, the main weapon warhead is armed and may then be initiated by any of the three fuze modules.

The second function of delay detonator 400 is to detect impact with a target, and to initiate the explosion of the main weapon warhead after the lapse of a set delay period. This is done through the use of inertial firing pin 403. Prior to launching of the round, the module (rotor) in the safe position prevents the inertial firing pin 403 from stabbing the pyrotechnic delay assemblies 406. During flight, inertial spring 415 maintains sufficient force bias to prevent inertial firing pin 403 from impacting with pyrotechnic delay assemblies 406. Only when the weapon impacts with a target, yielding a greater deceleration force than standard in-flight conditions, is inertial firing pin 403 able to overcome the inertial spring 415 bias force activate pyrotechnic delay assemblies 406. Pyrotechnic delay assemblies 406 take a pre-set amount of time to burn before it ignites pyrotechnic relay 401. Pyrotechnic relay 401 then activates fuze detonator 121 which, in turn, activates booster lead 527 and booster pellet 529 leading to detonation of the weapon warhead.

Figure 5:
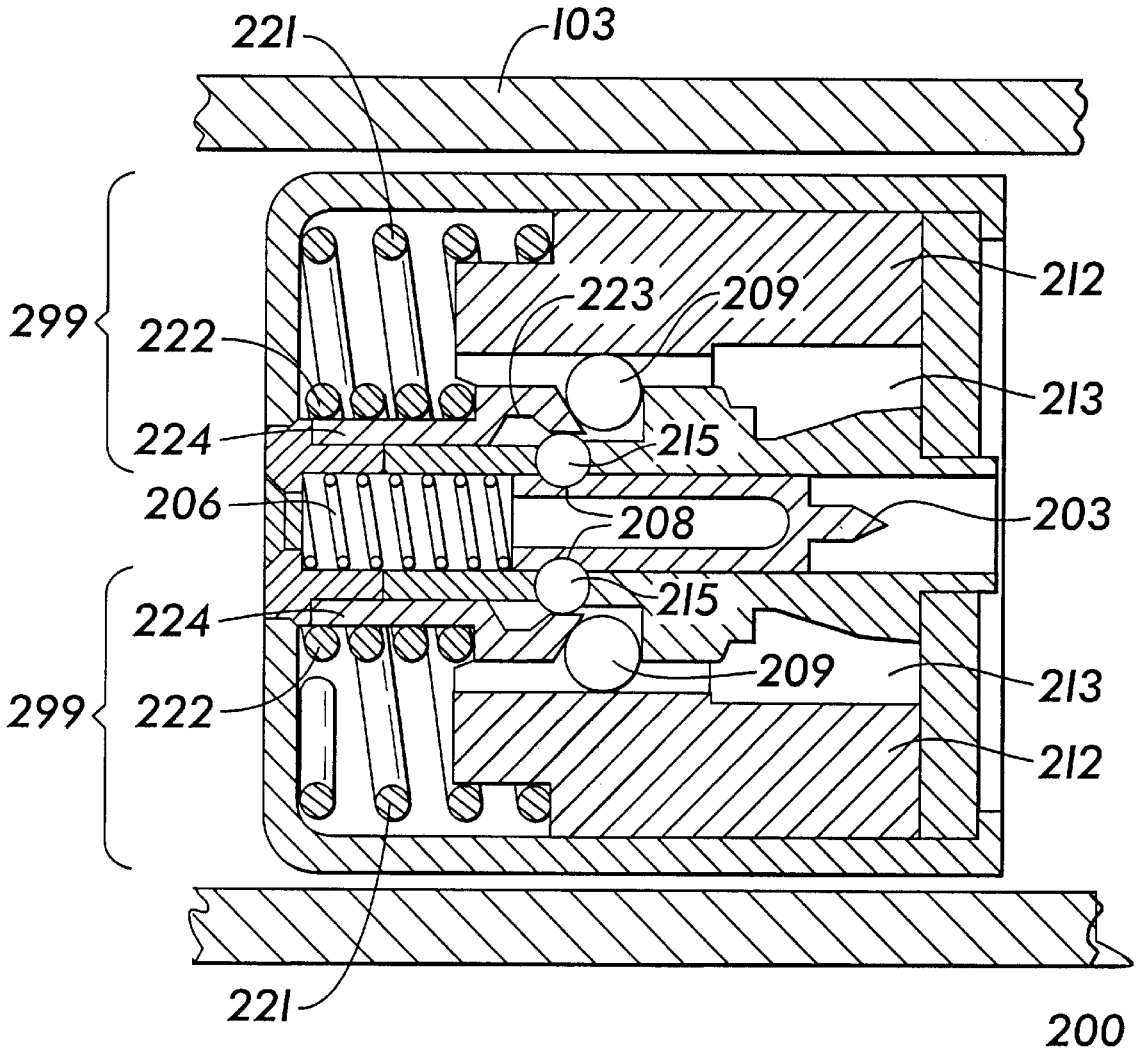
FIG. 5 is a cross-sectional side view of the void sensor.

Referring now to FIG. 5, a detailed view of void fuze 200 is shown. Upon impact with a solid object causing deceleration of the warhead, plunger 212 will move forward, compressing springs 221. Under sufficiently long enough deceleration, plunger 212 will move forward sufficiently such that balls 209 may enter ball detents 213 within plunger 212. The removal of balls 209 from their original position frees arm 224 to move. However, by the bias force of the spring 222 during continued deceleration, arms 224 will be held in place by its deceleration force against the compression force of compression spring 222. When deceleration decreases, as is the case when the delivery vehicle exits a target's exterior wall, the bias force of spring 222 moves arm 224 backward until their curvature is positioned such that balls 215 can drop in to slots in retainers 223 of arm 224. When balls 215 drop, they fall out of ball-shaped locks 208 of the void firing pin 203 such that it is no longer held in place, and will be immediately impelled into delay detonator 400 by void firing spring 206. The use of high precision springs and plungers allows the present invention to be easily configured for standard flight conditions and to certain tolerances in changes in normal deceleration. By varying the strength and weight of the components, the sensitivity of the fuze to changes in deceleration can be varied.

The benefits and novel features of the invention are numerous. The three distinct detonation means allow for warhead detonation to occur when the warhead impacts upon an impenetrable target, when the warhead achieves substantial penetration of a penetrable hard target or immediately after the warhead breaches the exterior skin of a soft target. The integrated fuze assembly allows for destruction of each of these target types automatically at impact time. No reconfiguration of the fuze or warhead is required prior to firing. Furthermore, the sensitivity of the fuze to changes in deceleration rate can be finely adjusted by simply varying the material composition and compliance of the fuze's springs.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A trimode fuze comprising:

a casing having an aft end, a center section and a forward end;

a delay detonator located within said casing at the aft end and having a delay firing pin;

a void fuze, located within said casing in the center section of the casing and being aligned with and rigidly attached to said delay detonator, and having a hollowed void firing pin with a path of movement aligned with a firing channel of said delay detonator; and a hard target impact detonator located within said casing in said forward end and aligned with and rigidly attached to said void fuze and having an impact firing pin with a path of movement aligned with said hollowed void firing pin and a stab detonator aligned with said impact firing pin.

2. A trimode fuze as in claim 1, wherein said void fuze further comprises an arming means for detecting a target impact deceleration and a detonating means for detecting threshold reduction of said deceleration.

3. A trimode fuze as in claim 2, wherein said arming means further comprises:

a compression spring having a front and a rear part;

a plunger connected to the rear part of said spring having ball detents; and a plurality of balls held in place by said plunger.

4. A trimode fuze as in claim 3, wherein said plunger moves during target impact deceleration such that the ball detents of said plunger align with said balls and allow said balls to move into said detents.

5. A trimode fuze as in claim 2, wherein said detonating means further comprises:

a spring;

an arm attached to said spring and having ball slots;

said hollowed void firing pin having a plurality of ball-shaped locks; and a plurality of balls positioned between said arm and said hollowed void firing pin such that said balls engage said ball-shaped locks and inhibit the movement of said hollowed void firing pin except when said balls enter ball-shaped receptacles on said arm.

6. A trimode fuze comprising:

a casing having a front end, a center section and an aft end;

a first means for detonating upon impact with an impenetrable target located within said casing at the front end of said casing;

a second means for immediately detonating after breaching an outer skin of a soft target, located within the center section of said casing, said means aligned with and connected to said first means for detonating said second means comprising an arming device for detecting deceleration caused by target impact and a detonator device comprising a hollowed void firing pin activated by changes in deceleration, said arming and detonator devices further comprising a compression spring having a front and a rear part;

a plurality of balls held in place by a plunger;

said plunger, connected to the rear part of said spring, and having ball detents wherein said plunger moves during target impact deceleration such that the ball detents of said plunger align with said balls and allow said balls to move into said detents; and a third means for detonating after a predetermined period of constant or increasing deceleration located in the aft end of said casing and aligned with and connected to said second detonating means.

7. A trimode fuze as in claim 6 wherein said first detonating means further comprises:

a hard-target actuated impact firing pin; and an impact stab detonator aligned with said impact firing pin such that said impact firing pin can be impelled into said impact stab detonator.

8. A trimode fuze as in claim 6 wherein said third detonating means further comprises:

a delay assembly having a pyrotechnic relay and timer; and an inertially-operated firing pin aligned with said timer.

* * * * *